US011682517B2

(12) United States Patent
Hamada et al.

(10) Patent No.: US 11,682,517 B2
(45) Date of Patent: Jun. 20, 2023

(54) INDUCTOR COMPONENT

(71) Applicant: Murata Manufacturing Co., Ltd., Kyoto-fu (JP)

(72) Inventors: Akinori Hamada, Nagaokakyo (JP); Hayami Kudo, Nagaokakyo (JP); Koichi Yamaguchi, Nagaokakyo (JP); Yoshimasa Yoshioka, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 781 days.

(21) Appl. No.: 16/572,413

(22) Filed: Sep. 16, 2019

(65) Prior Publication Data

US 2020/0098506 A1 Mar. 26, 2020

(30) Foreign Application Priority Data

Sep. 25, 2018 (JP) ..... 2018-179280

(51) Int. Cl.
*H01F 27/29* (2006.01)
*H01F 27/28* (2006.01)
(Continued)

(52) U.S. Cl.
CPC ..... *H01F 27/2804* (2013.01); *H01F 27/29* (2013.01); *H01F 27/32* (2013.01);
(Continued)

(58) Field of Classification Search
CPC ..... G01R 15/181; G01R 19/0092; G01R 15/142; G01R 31/58; G01R 19/2513;
(Continued)

(56) References Cited

U.S. PATENT DOCUMENTS

2007/0139154 A1* 6/2007 Aoki ..... H01F 17/0006 257/E21.022
2014/0176286 A1* 6/2014 Okada ..... H01F 17/0013 336/200

(Continued)

FOREIGN PATENT DOCUMENTS

CN 107818864 A 3/2018
JP 2017-107971 A 6/2017

*Primary Examiner* — Mang Tin Bik Lian
(74) *Attorney, Agent, or Firm* — Studebaker & Brackett PC

(57) ABSTRACT

An inductor component comprises an element body; first and second inductors in the body; first and second columnar wirings in the body with end surfaces exposed from a first principal surface of the body and electrically connected to the first inductor; third and fourth columnar wirings in the body with end surfaces exposed from the first principal surface and electrically connected to the second inductor; first through fourth external terminals contacting the end surfaces of the first through fourth columnar wirings, respectively; and an insulating film on the first principal surface covering a portion of the end surface of the first and third columnar wiring not contacting the first and third terminals, respectively. The first terminal is closer to the third terminal than the fourth terminal, and a shortest distance between the first and third terminals is longer than a shortest distance between the first and third columnar wirings.

20 Claims, 4 Drawing Sheets

(51) Int. Cl.
*H01F 41/04* (2006.01)
*H01F 41/02* (2006.01)
*H01F 27/32* (2006.01)

(52) U.S. Cl.
CPC ..... *H01F 41/0233* (2013.01); *H01F 41/041* (2013.01); *H01F 2027/2809* (2013.01)

(58) Field of Classification Search
CPC ..... H01F 27/2804; H01F 27/29; H01F 27/32; H01F 2027/2809; H01F 17/0006; H01F 19/04; H01F 27/324; H01F 2017/0066; H01F 27/255; H01F 27/292; H01F 27/28; H01F 2017/002; H01F 2017/0073
See application file for complete search history.

(56) References Cited

U.S. PATENT DOCUMENTS

| | | | | |
|---|---|---|---|---|
| 2016/0078986 | A1* | 3/2016 | Yoon | H01F 5/04 336/83 |
| 2016/0078994 | A1* | 3/2016 | Yoon | H01F 5/00 336/200 |
| 2017/0006706 | A1* | 1/2017 | Yoon | H01F 17/0033 |
| 2017/0111995 | A1* | 4/2017 | Nishikawa | H01F 27/2804 |
| 2017/0148561 | A1* | 5/2017 | Yoon | H05K 1/181 |
| 2017/0169930 | A1* | 6/2017 | Kudo | H01F 17/0013 |
| 2018/0286568 | A1* | 10/2018 | Suzuki | H01F 41/122 |
| 2019/0259527 | A1* | 8/2019 | Yoon | H01F 17/0033 |

* cited by examiner

INDUCTOR COMPONENT

CROSS REFERENCE TO RELATED APPLICATION

This application claims benefit of priority to Japanese Patent Application 2018-179280 filed Sep. 25, 2018, the entire content of which is incorporated herein by reference.

BACKGROUND

Technical Field

The present disclosure relates to an inductor component.

Background Art

A conventional inductor component is described in Japanese Laid-Open Patent Publication No. 2017-107971. This inductor component includes a spiral wiring, a magnetic composite body covering the spiral wiring, an internal electrode that is embedded in the magnetic composite body with an end surface exposed from an outer surface of the magnetic composite body and that is electrically connected to the spiral wiring, and an external terminal disposed on the outer surface of the magnetic composite body and electrically connected to the internal electrode. The external terminal includes a metal film in contact with the magnetic composite body and the end surface of the internal electrode, and the area of the metal film is larger than the area of the end surface of the internal electrode.

SUMMARY

An inductor component may incorporate a plurality of inductors, which increases the number of external terminals by the number of inductors, and the external terminals are arranged on the same surface in consideration of the mountability to a substrate. In this case, a shortest distance between adjacent external terminals must be ensured at a certain level or more from the viewpoint of preventing a short circuit of mounting solder at the time of mounting of the inductor component on a substrate. Therefore, if a plurality of inductors is incorporated without changing the conventional configuration of the inductor component as described above, the external terminals are larger than areas of end surfaces of internal electrodes, and therefore, to ensure a shortest distance between adjacent external terminals at a certain level or more, a larger shortest distance must be ensured between adjacent internal electrodes.

This restriction on a formation region of the internal electrodes may not only reduce a degree of freedom in design but also become an obstacle for acquiring characteristics of the inductor component. For example, if the shortest distance between the internal electrodes is ensured in a certain outer shape of the inductor component, this places a restriction on an upper limit of the areas of the end surfaces of the internal electrodes, and the DC resistance of the inductor component is sacrificed. Therefore, the conventional configuration of the inductor component as described above is not suitable for incorporating a plurality of inductors.

The present disclosure is to provide an inductor component having a configuration suitable for incorporating a plurality of inductors.

Therefore, the present disclosure provides an inductor component comprising an element body; and a first inductor and a second inductor disposed in the element body. The inductor component also comprises first and second columnar wirings that are embedded in the element body with end surfaces exposed from a first principal surface of the element body and that are electrically connected to the first inductor, and third and fourth columnar wirings that are embedded in the element body with end surfaces exposed from the first principal surface of the element body and that are electrically connected to the second inductor. The inductor component further comprises a first external terminal in contact with the end surface of the first columnar wiring, a second external terminal in contact with the end surface of the second columnar wiring, a third external terminal in contact with the end surface of the third columnar wiring, and a fourth external terminal in contact with the end surface of the fourth columnar wiring; and an insulating film disposed on the first principal surface of the element body. The first external terminal is located closer to the third external terminal than the fourth external terminal. Also, a shortest distance between the first external terminal and the third external terminal is longer than a shortest distance between the first columnar wiring and the third columnar wiring. Furthermore, the insulating film covers a portion of the end surface of the first columnar wiring not in contact with the first external terminal and a portion of the end surface of the third columnar wiring not in contact with the third external terminal.

According to the aspect, the shortest distance between the first columnar wiring and the third columnar wiring is not restricted by the shortest distance between the first external terminal and the third external terminal, and a restriction on the formation region of the first columnar wiring and the third columnar wiring can be reduced.

In an embodiment of the inductor component, the element body includes a magnetic layer covering the first inductor and the second inductor and made of a resin containing a metal magnetic powder. According to the embodiment, a formation region of the magnetic layer has an increased influence on the characteristics of the inductor component in this configuration, and therefore, the reduction in restriction on the formation region of the first columnar wiring and the third columnar wiring becomes even more effective.

In an embodiment of the inductor component, the first external terminal includes a metal film in contact with the resin and the metal magnetic powder of the magnetic layer and the end surface of the first columnar wiring. According to the embodiment, the first external terminal includes the metal film in contact with the resin and the metal magnetic powder of the magnetic layer and the end surface of the columnar wiring and therefore can ensure the adhesion between the first external terminal and the magnetic layer, the film strength of the first external terminal itself, and the electric conductivity of the first external terminal.

In an embodiment of the inductor component, the first external terminal is disposed from the end surface of the first columnar wiring onto the first principal surface of the element body. According to the embodiment, the first external terminal can be made larger.

In an embodiment of the inductor component, a portion of the first external terminal disposed to extend onto the first principal surface does not extend in the direction toward the third external terminal According to the embodiment, the first external terminal can be made larger without affecting the shortest distance between the first external terminal and the third external terminal.

In an embodiment of the inductor component, the first principal surface of the element body includes a linearly extending first end edge, and the first external terminal and the third external terminal are arranged along the first end edge. According to the embodiment, since the first external terminal and the third external terminal are disposed on the first end edge side, the mountability of the inductor component is improved.

In an embodiment of the inductor component, the first principal surface of the element body includes a linearly extending first end edge, and the first external terminal and the third external terminal are arranged obliquely with respect to a direction of extension of the first end edge. According to the embodiment, the shortest distance between the first external terminal and the third external terminal is ensured obliquely with respect to the first end edge, so that the first end edge can be made smaller without being restricted by the shortest distance.

In an embodiment of the inductor component, when viewed in a direction orthogonal to the first principal surface of the element body, the first external terminal and the third external terminal are elliptical or circular. According to the embodiment, since the first external terminal and the third external terminal are elliptical or circular, the first external terminal and the third external terminal can be made closer without changing the shortest distance between the first external terminal and the third external terminal.

In an embodiment of the inductor component, the shortest distance between the first external terminal and the third external terminal in a direction along the first end edge is 350 μm or less. According to the embodiment, the outer shape of the inductor component along the first end edge can be made smaller than usual while maintaining prevention of short-circuiting of mounting solder at the time of mounting on a substrate.

In an embodiment of the inductor component, the second external terminal is located closer to the fourth external terminal than the third external terminal, a shortest distance between the second external terminal and the fourth external terminal is longer than a shortest distance between the second columnar wiring and the fourth columnar wiring, and the insulating film covers a portion of the end surface of the second columnar wiring not in contact with the second external terminal and a portion of the end surface of the fourth columnar wiring not in contact with the fourth external terminal. According to the embodiment, the shortest distance between the second columnar wiring and the fourth columnar wiring is not restricted by the shortest distance between the second external terminal and the fourth external terminal, and a restriction on the formation region of the second columnar wiring and the fourth columnar wiring can be reduced.

In an embodiment of the inductor component, the first columnar wiring, the second columnar wiring, the third columnar wiring, and the fourth columnar wiring linearly extend from the first inductor and the second inductor to the end surfaces in a direction orthogonal to the end surfaces. According to the embodiment, the first external terminal, the second external terminal, the third external terminal, and the fourth external terminal can be connected to the first inductor and the second inductor at a shorter distance.

In an embodiment of the inductor component, the first inductor and the second inductor include spiral wirings disposed parallel to the first principal surface of the element body. According to the embodiment, the first inductor and the second inductor can be configured in a direction parallel to the first principal surface, and the inductor component can be reduced in height.

In this description, the spiral wiring means a curve (two-dimensional curve) extending on a plane, may be a curve having the number of turns exceeding one or may be a curve having the number of turns less than one, or may have a portion that is a straight line.

According to the inductor component of an aspect of the present disclosure, an inductor component having a configuration suitable for incorporating a plurality of inductors can be provided.

DETAILED DESCRIPTION

An inductor component of an aspect of the present disclosure will now be described in detail with reference to shown embodiments. The drawings include schematics and may not reflect actual dimensions or ratios.

First Embodiment (Configuration)

Figure 1A:
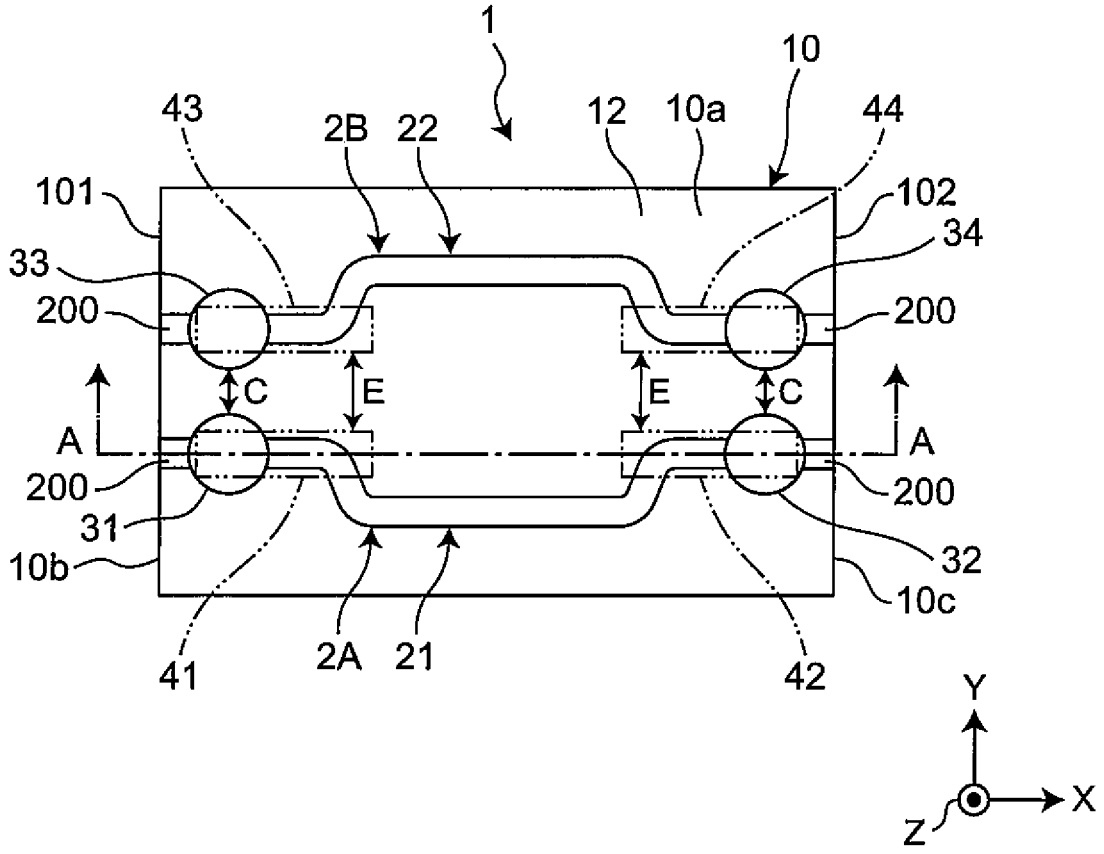
FIG. 1A is transparent plan view showing a first embodiment of an inductor component.
Figure 1B:
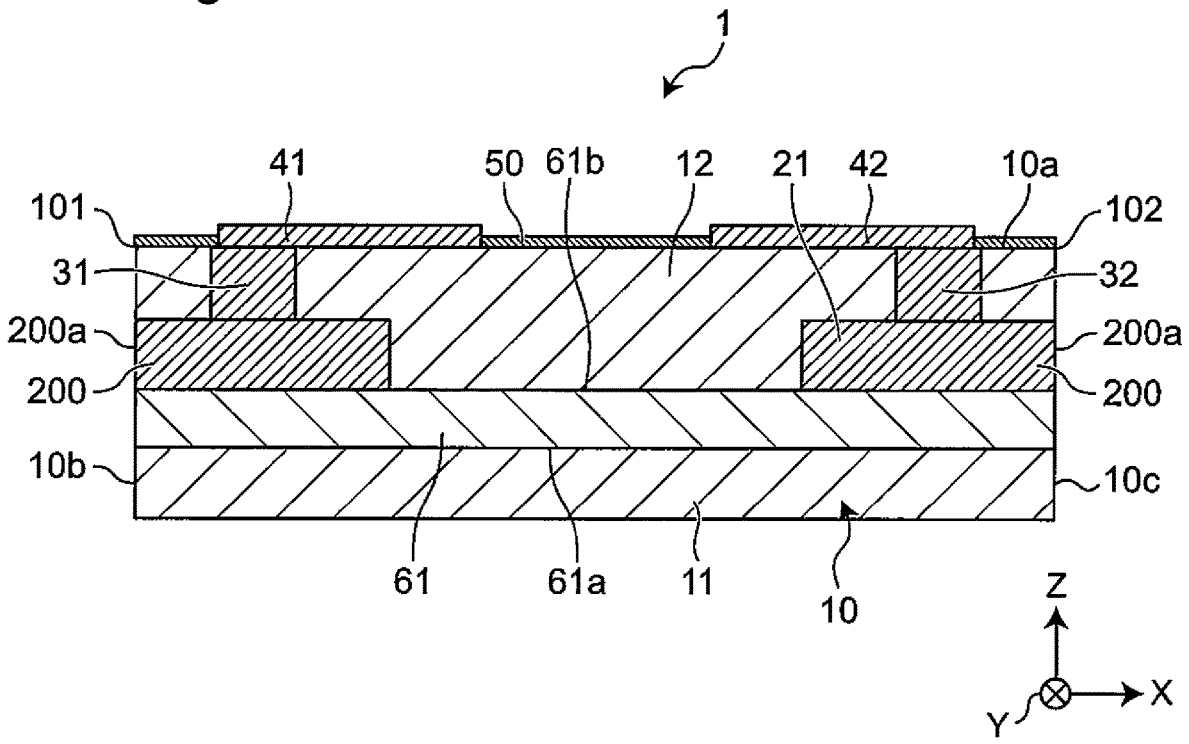
FIG. 1B is a cross-sectional view taken along a line A-A of FIG. 1A.
Figure 2:
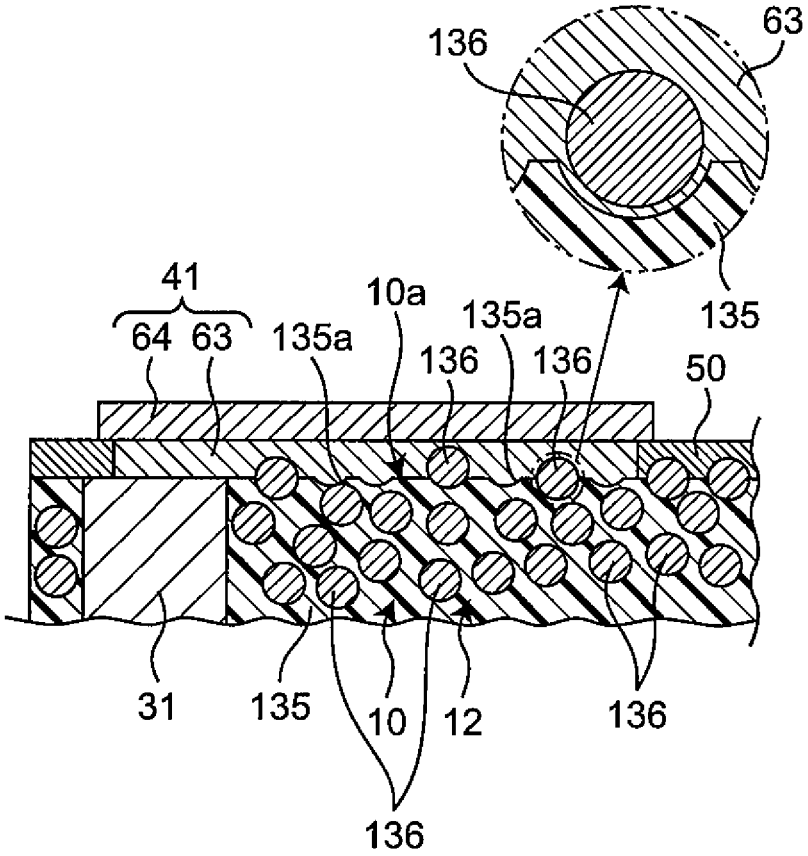
FIG. 2 is a partially enlarged view of FIG. 1B.

FIG. 1A is a transparent plan view showing a first embodiment of an inductor component. FIG. 1B is a cross-sectional view taken along a line A-A of FIG. 1A. FIG. 2 is a partially enlarged view of FIG. 1B.

An inductor component 1 is mounted on an electronic device such as a personal computer, a DVD player, a digital camera, a TV, a portable telephone, and automotive electronics, for example, and is a component generally having a rectangular parallelepiped shape, for example. However, the shape of the inductor component 1 is not particularly limited and may be a circular columnar shape, a polygonal columnar shape, a truncated cone shape, or a truncated polygonal pyramid shape.

As shown in FIGS. 1A and 1B, the inductor component 1 includes: an element body 10; a first inductor 2A and a second inductor 2B disposed in the element body 10; a first columnar wiring 31, a second columnar wiring 32, a third columnar wiring 33, and a fourth columnar wiring 34 embedded in the element body 10 with end surfaces exposed from a first principal surface 10*a* of the element body 10; a first external terminal 41, a second external terminal 42, a third external terminal 43, and a fourth external terminal 44 disposed on the first principal surface 10*a* of the element body 10; and an insulating film 50 disposed on the first principal surface 10*a* of the element body 10. In the figures, it is assumed that a thickness direction of the inductor component 1 is a Z direction and that a forward Z direction and a reverse Z direction face upward and downward, respectively. It is assumed that in a plane orthogonal to the Z direction of the inductor component 1, a length direction of the inductor component 1 is an X direction while a width direction of the inductor component 1 is a Y direction.

The element body 10 includes an insulating layer 61, a first magnetic layer 11 disposed on a lower surface 61*a* of the insulating layer 61, and a second magnetic layer 12 disposed on an upper surface 61*b* of the insulating layer 61. The first principal surface 10*a* of the element body 10 corresponds to an upper surface of the second magnetic layer 12. The element body 10 has a three-layer structure including the insulating layer 61, the first magnetic layer 11, and the second magnetic layer 12, or may have a single-layer structure including at least only the magnetic layer.

The insulating layer 61 is a layer having a rectangular principal surface and the thickness of the insulating layer 61 is 10 μm or more and 100 μm or less (i.e., from 10 μm to 100 μm), for example. The insulating layer 61 is preferably an insulating resin layer of epoxy resin, polyimide resin, etc. containing no base material such as glass cloth from the viewpoint of height reduction, for example, or may be a sintered body of a magnetic substance layer such as NiZn- or MnZn-based ferrite or a nonmagnetic substance layer such as alumina or glass, or may be a resin layer containing a base material such as glass epoxy. If the insulating layer 61 is a sintered body, the strength and flatness of the insulating layer 61 can be ensured, and a workability of a laminated object on the insulating layer 61 is improved. If the insulating layer 61 is a sintered body, the insulating layer is preferably subjected to polishing processing from the viewpoint of height reduction and is particularly preferably polished from the lower side without a laminated object.

The first magnetic layer 11 and the second magnetic layer 12 are magnetic resin layers made of a resin 135 containing a metal magnetic powder 136. The resin 135 is an organic insulating material made of epoxy resin, bismaleimide, liquid crystal polymer, or polyimide, for example. The metal magnetic powder 136 has an average particle diameter of 0.1 μm or more and 5 μm or less (i.e., from 0.1 μm to 5 μm), for example. In a manufacturing stage of the inductor component 1, the average particle diameter of the metal magnetic powder 136 can be calculated as a particle diameter corresponding to 50% of an integrated value in particle size distribution obtained by a laser diffraction/scattering method. The metal magnetic powder 136 is made of, for example, an FeSi alloy such as FeSiCr, an FeCo alloy, an Fe alloy such as NiFe, or an amorphous alloy thereof. The content percentage of the metal magnetic powder 136 is, preferably, 20 vol % or more and 70 vol % or less (i.e., from 20 vol % to 70 vol %) relative to the whole magnetic layer. When the average particle diameter of the metal magnetic powder 136 is 5 μm or less, the DC superimposition characteristics are further improved, and an iron loss at high frequency can be reduced by fine powder. Instead of the metal magnetic powder, magnetic powder of NiZn- or MnZn-based ferrite may be used.

The first inductor 2A and the second inductor 2B include a first spiral wiring 21 and a second spiral wiring 22 disposed parallel to the first principal surface 10*a* of the element body 10. As a result, the first inductor 2A and the second inductor 2B can be configured in a direction parallel to the first principal surface 10*a*, and the inductor component 1 can be reduced in height. The first spiral wiring 21 and the second spiral wiring 22 are disposed on the same plane in the element body 10. Specifically, the first spiral wiring 21 and the second spiral wiring 22 are formed only on the upper side of the insulating layer 61, i.e., the upper surface 61*b* of the insulating layer 61, and are covered by the second magnetic layer 12.

The first and second spiral wirings 21, 22 are wound into a planar shape. Specifically, the first and second spiral wirings 21, 22 have a semi-elliptical arc shape when viewed in the Z direction. Therefore, each of the first and second spiral wirings 21, 22 is a curved wiring wound around about a half of the circumference. The first and second spiral wirings 21, 22 each include a linear part in a middle portion.

The thickness of the first and second spiral wirings 21, 22 is preferably 40 μm or more and 120 μm or less (i.e., from 40 μm to 120 μm), for example. An example of the first and second spiral wirings 21, 22 has a thickness of 45 μm, a wiring width of 40 μm, and an inter-wiring space of 10 μm. The inter-wiring space is preferably 3 μm or more and 20 μm or less (i.e., from 3 μm to 20 μm).

The first and second spiral wirings 21, 22 are made of a conductive material and are made of a metal material having a low electric resistance such as Cu, Ag, and Au, for example. In this embodiment, the inductor component 1 includes only one layer of the first and second spiral wirings 21, 22, so that the inductor component 1 can be reduced in height.

The first spiral wiring 21 has a first end and a second end electrically connected to the first columnar wiring 31 and the second columnar wiring 32, respectively, located on the outer side and has a curved shape drawing an arc from the first columnar wiring 31 and the second columnar wiring 32 toward the center side of the inductor component 1. Therefore, the first spiral wiring 21 has both ends provided with pad portions having a line width larger than a spiral-shaped portion and is directly connected at the pad portions to the first and second columnar wirings 31, 32.

Similarly, The second spiral wiring 22 has a first end and a second end electrically connected to the third columnar wiring 33 and the fourth columnar wiring 32, respectively, located on the outer side and has a curved shape drawing an arc from the third columnar wiring 33 and the fourth columnar wiring 34 toward the center side of the inductor component 1.

It is assumed that an inner diameter portion of each of the first and second spiral wirings 21, 22 is defined as an area surrounded by the curve drawn by the first and second spiral wirings 21, 22 and the straight line connecting both ends of the first and second spiral wirings 21, 22. In this case, neither of the first and second spiral wirings 21, 22 have the inner diameter portions overlapping with each other when viewed in the Z direction. On the other hand, the first and second spiral wirings 21, 22 are away from each other in their respective arc portions.

The first and second spiral wirings 21, 22 have wirings further extending toward the outside of the chip from connecting positions for the first to fourth columnar wirings 31 to 34, and these wirings are exposed to the outside of the chip. Therefore, the first and second spiral wirings 21, 22 have exposed portions 200 exposed to the outside from side surfaces parallel to the lamination direction of the inductor component 1.

These wirings are wirings connected to a power feeding wiring when additional electrolytic plating is performed after forming the shapes of the first and second spiral wirings 21, 22 in the manufacturing process of the inductor component 1. With this power feeding wiring, the additional electrolytic plating can easily be performed in an inductor substrate state before singulation of the inductor component 1, and an inter-wiring distance can be narrowed. Additionally, since the inter-wiring distance is narrowed by performing the additional electrolytic plating, the magnetic coupling can be enhanced between the first and second spiral wirings 21, 22.

Since the spiral wirings 21, 22 have the exposed portions 200, a resistance to electrostatic destruction can be ensured at the time of processing of the inductor substrate. In the spiral wirings 21, 22, a thickness of an exposed surface 200*a* of the exposed portion 200 is preferably equal to or less than the thickness of the spiral wirings 21, 22 and equal to or greater than 45 μm. As a result, since the thickness of the exposed surface 200*a* is equal to or less than the thickness of the spiral wirings 21, 22, the proportion of the magnetic layers 11, 12 can be increased, and the inductance can be improved. Additionally, since the thickness of the exposed surface 200*a* is equal to or greater than 45 μm, occurrence of disconnection can be reduced. Preferably, the exposed surface 200*a* is an oxide film. As a result, a short circuit can be suppressed between the inductor component 1 and an adjacent component.

The first to fourth columnar wirings 31 to 34 extend from the spiral wirings 21, 22 in the Z direction and penetrate the inside of the second magnetic layer 12. The first columnar wiring 31 extends upward from an upper surface of one end of the first spiral wiring 21, and an end surface of the first columnar wiring 31 is exposed from the first principal surface 10*a* of the element body 10. The second columnar wiring 32 extends upward from an upper surface of the other end of the first spiral wiring 21, and an end surface of the second columnar wiring 32 is exposed from the first principal surface 10*a* of the element body 10.

The third columnar wiring 33 extends upward from an upper surface of one end of the second spiral wiring 22, and an end surface of the third columnar wiring 33 is exposed from the first principal surface 10*a* of the element body 10. The fourth columnar wiring 34 extends upward from an upper surface of the other end of the second spiral wiring 22, and an end surface of the fourth columnar wiring 34 is exposed from the first principal surface 10*a* of the element body 10. Therefore, the first columnar wiring 31, the second columnar wiring 32, the third columnar wiring 33, and the fourth columnar wiring 34 linearly extend from the first inductor 2A and the second inductor 2B to the end surfaces exposed from the first principal surface 10*a* in the direction orthogonal to the end surfaces. As a result, the first external terminal 41, the second external terminal 42, the third external terminal 43, and the fourth external terminal 44 can be connected to the first inductor 2A and the second inductor 2B at a shorter distance, so that the inductor component 1*a* can be reduced in resistance and increased in inductance. The first to fourth columnar wirings 31 to 34 are made of a conductive material and are made of, for example, the same material as the spiral wirings 21, 22.

The first to fourth external terminals 41 to 44 are disposed on the first principal surface 10*a* of the element body 10 (the upper surface of the second magnetic layer 12). The first to fourth external terminals 41 to 44 are made of a conductive material and has, for example, a three-layer configuration with Cu having low electric resistance and excellent in stress resistance, Ni excellent in corrosion resistance, and Au excellent in solder wettability and reliability arranged in this order from the inside to the outside.

The first external terminal 41 is in contact with the end surface of the first columnar wiring 31 exposed from the first principal surface 10*a* of the element body 10 and is electrically connected to the first columnar wiring 31. Therefore, the first external terminal 41 is electrically connected to the one end of the first spiral wiring 21. The second external terminal 42 is in contact with the end surface of the second columnar wiring 32 exposed from the first principal surface 10*a* of the element body 10 and is electrically connected to the second columnar wiring 32. As a result, the second external terminal 42 is electrically connected to the other end of the first spiral wiring 21.

Similarly, the third external terminal 43 is in contact with the end surface of the third columnar wiring 33 and is electrically connected to the third columnar wiring 33 and electrically connected to the one end of the second spiral wiring 22. The fourth external terminal 44 is in contact with the end surface of the fourth columnar wiring 34 and is electrically connected to the fourth columnar wiring 34 and electrically connected to the other end of the second spiral wiring 22.

In the inductor component 1, the first principal surface 10*a* has a first end edge 101 and a second end edge 102 extending in a linear shape corresponding to a side of a rectangular shape. The first end edge 101 and the second end edge 102 are the end edges of the first principal surface 10*a* leading to a first side surface 10*b* and a second side surface 10*c*, respectively, of the element body 10. The first external terminal 41 and the third external terminal 43 are arranged along the first end edge 101 on the first side surface 10*b* side of the element body 10, and the second external terminal 42 and the fourth external terminal 44 are arranged along the second end edge 102 on the second side surface 10*c* side of the element body 10. when viewed in the direction orthogonal to the first principal surface 10*a* of the element body 10, the first side surface 10*b* and the second side surface 10*c* of the element body 10 are surfaces along the Y direction and coincide with the first end edge 101 and the second end edge 102. The arrangement direction of the first external terminal 41 and the third external terminal 43 is a direction connecting the center of the first external terminal 41 and the center of the third external terminal 43, and the arrangement direction of the second external terminal 42 and the fourth external terminal 44 is a direction connecting the center of the second external terminal 42 and the center of the fourth external terminal 44.

The insulating film 50 is disposed on a portion of the first principal surface 10*a* of the element body 10 where the first to fourth external terminals 41 to 44 are not disposed. However, the insulating film 50 may have end portions of the first to fourth external terminals 41 to 44 placed thereon and thereby overlap with the first to fourth external terminals 41 to 44. The insulating film 50 is made of, for example, a resin material having high electric insulation, such as acrylic resin, epoxy resin, and polyimide. As a result, the insulation among the first to fourth external terminals 41 to 44 can be improved. The insulating film 50 serves as a mask at the time of pattern formation of the first to fourth external terminals 41 to 44, so that the manufacturing efficiency is improved. When the metal magnetic powder 136 is exposed from the resin 135, the insulating film 50 can cover the exposed metal magnetic powder 136 to prevent the metal magnetic powder 136 from being exposed to the outside. The insulating film 50 may contain a filler made of an insulating material.

In the inductor component 1, the first external terminal 41 is located closer to the third external terminal 43 than the fourth external terminal 44, and a shortest distance E between the first external terminal 41 and the third external terminal 43 is longer than a shortest distance C between the first columnar wiring 31 and the third columnar wiring 33. The insulating film 50 covers a portion of the end surface of the first columnar wiring 31 not in contact with the first external terminal 41 and a portion of the end surface of the third columnar wiring 33 not in contact with the third external terminal 43.

Since the first and third external terminals 41, 43 are arranged in the direction (Y direction) along the first side surface 10*b* of the element body 10 and the first and third columnar wirings 31, 33 are arranged in the direction (Y direction) along the first side surface 10*b* of the element body 10 while the first and third external terminals 41, 43 are rectangular and the first and third columnar wirings 31, 33 are circular, the distances C, E are distances in the direction (Y direction) along the first side surface 10*b* of the element body 10.

According to the configuration, the portions of the first columnar wiring 31 and the third columnar wiring 33 not in contact with the first external terminal 41 and the third external terminal 43 are covered by the insulating film 50, so that no mounting solder adheres to the portions when the inductor component 1 mounted on the substrate. Therefore, the prevention of short-circuiting of the mounting solder may be ensured only in terms of the shortest distance E, and the shortest distance C is not affected. Thus, in the inductor component 1, the shortest distance C between the first columnar wiring 31 and the third columnar wiring 33 is not restricted by the shortest distance E between the first external terminal 41 and the third external terminal 43, and a restriction on the formation region of the first columnar wiring 31 and the third columnar wiring 33 can be reduced.

As described above, since the restriction on the formation region of the first columnar wiring 31 and the third columnar wiring 33 is reduced even when the plurality of the first and second inductors 2A, 2B is incorporated, the inductor component 1 has a configuration improving a degree of freedom in design, forming no obstacle for acquiring characteristics of the inductor component 1, and suitable for incorporating a plurality of inductors.

Similarly, in the inductor component 1, the second external terminal 42 is located closer to the fourth external terminal 44 than the third external terminal 43, and the shortest distance E between the second external terminal 42 and the fourth external terminal 44 is longer than the shortest distance C between the second columnar wiring 32 and the fourth columnar wiring 34. The insulating film 50 covers a portion of the end surface of the second columnar wiring 32 not in contact with the second external terminal 42 and a portion of the end surface of the fourth columnar wiring 34 not in contact with the fourth external terminal 44.

Thus, the shortest distance C between the second columnar wiring 32 and the fourth columnar wiring 34 is not restricted by the shortest distance E between the second external terminal 42 and the fourth external terminal 44, and a restriction on the formation region of the second columnar wiring 32 and the fourth columnar wiring 34 can be reduced.

Therefore, the inductor component 1 has a more suitable configuration for incorporating a plurality of inductors.

In the inductor component 1, the element body 10 has the second magnetic layer 12 made of the resin 135 covering the first inductor 2A and the second inductor 2B and containing the metal magnetic powder 136.

As a result, the inductor component 1 has a configuration in which the formation region of the second magnetic layer 12 has an increased influence on the characteristics of the inductor component 1; however, since the inductor component 1 is reduced in restriction on the formation region of the first columnar wiring 31 and the third columnar wiring 33 considered as the formation region of the second magnetic layer 12 from another viewpoint, the restriction on the formation region of the second magnetic layer 12 is also reduced, and the characteristics of the inductor component 1 can be set with a higher degree of freedom. Therefore, in the inductor component 1, the reduction in restriction on the formation region of the first columnar wiring 31 and the third columnar wiring 33 becomes even more effective.

In the inductor component 1, the first external terminal 41 intersects the outline of the end surface of the first columnar wiring 31 when viewed in the direction orthogonal to the first principal surface 10*a* of the element body 10. In other words, the first external terminal 41 is disposed to extend from the end surface of the first columnar wiring 31 onto the first principal surface 10*a* of the element body 10. As a result, the first external terminal 41 can be made larger. Particularly, the longitudinal direction of the first external terminal 41 extends in the X direction, and a portion of the first external terminal 41 disposed to extend onto the first principal surface 10*a* does not extend in the direction toward the third external terminal 43. Therefore, the first external terminal 41 can be made larger without affecting the shortest distance E between the first external terminal 41 and the third external terminal 43.

Similarly, the third external terminal 43 intersects the outline of the end surface of the third columnar wiring 33 when viewed in the direction orthogonal to the first principal surface 10*a* of the element body 10. In other words, the third external terminal 43 is disposed to extend from the end surface of the third columnar wiring 33 onto the first principal surface 10*a* of the element body 10. As a result, the third external terminal 43 can be made larger. Particularly, the longitudinal direction of the third external terminal 43 extends in the X direction, and the portion of the third external terminal 43 disposed to extend onto the first principal surface 10*a* does not extend in the direction toward the first external terminal 41. Therefore, the third external terminal 43 can be made larger without affecting the shortest distance E between the first external terminal 41 and the third external terminal 43.

Similarly, when viewed in the direction orthogonal to the first principal surface 10*a* of the element body 10, the second external terminal 42 intersects the outline of the end surface of the second columnar wiring 32, and the fourth external terminal 44 intersects the outline of the end surface of the fourth columnar wiring 34. Therefore, the areas of the second and fourth external terminals 42, 44 can be made larger. Specifically, the second external terminal 42 and the fourth external terminal 44 are disposed to extend from the end surfaces of the second columnar wiring 32 and the fourth columnar wiring 33, respectively, onto the first principal surface 10*a* of the element body 10. Therefore, the second external terminal 42 and the fourth external terminal 44 can be made larger.

Particularly, the longitudinal directions of the second external terminal 42 and the fourth external terminal 44 extend in the X direction, and the portions of the second external terminal 42 and the fourth external terminal 44 disposed to extend onto the first principal surface 10*a* do not extend in the directions toward the fourth external terminal 44 and the second external terminal 42, respectively. Therefore, the second external terminal 42 and the fourth external terminal 44 can be made larger without affecting the shortest distance E between the second external terminal 42 and the fourth external terminal 44.

In the inductor component 1, as shown in FIG. 2, the first external terminal 41 has a metal film 63 and a coating film 64 covering the metal film 63. The metal film 63 is in contact with the upper surface of the second magnetic layer 12 (the first principal surface 10*a* of the element body 10). More specifically, the metal film 63 is in contact with the resin 135 and the metal magnetic powder 136 of the second magnetic layer 12 and the end surface of the first columnar wiring 31. As a result, the first external terminal 41 can ensure the adhesion between the first external terminal 41 and the second magnetic layer 12, the film strength of the first external terminal 41 itself, and the electric conductivity of the first external terminal 41. The second to fourth external terminals 42 to 44 are the same as the first external terminal 41, and therefore, the subsequent description of the second to fourth external terminals 42 to 44 will not be made.

The metal film 63 is made of a low-resistance metal such as Cu, Ag, and Au, for example. The material of the metal film 63 is preferably a metal of the same type as the material of the columnar wiring, and in this case, the connection reliability between the metal film 63 and the first columnar wiring 31 can be improved. The metal film 63 is preferably formed by electroless plating as described later. The metal film 63 may be formed by electrolytic plating, sputtering, vapor deposition, etc. The coating film 64 is made of a material having high resistance to solder leaching and high solder wettability such as SnNi, for example, and is formed on an upper surface of the metal film 63 by plating. Since the first external terminal 41 has the metal film 63 and the coating film 64 covering the metal film 63 in this way, the low-resistance material and the material having high resistance to solder leaching and high solder wettability can be used for the metal film 63 and the coating film 64, respectively, as described above, for example Therefore, a degree of freedom in design of the first external terminal 41 is improved in such a manner that the first external terminal 41 excellent in conductivity, reliability, and solderability can be formed.

On the other hand, the coating film 64 may be made of the same material as the metal film 63 and, for example, the metal film 63 and the coating film 64 may be a Cu layer formed by electroless plating and a Cu layer formed by electrolytic plating, respectively. In this case, by covering a side surface of the inductor component 1 with the low-resistance coating film 64, the side surface can be soldered. The coating film 64 may have a laminated structure and, for example, may have a configuration in which a surface of a Cu layer is covered by a layer of SnNi etc. Furthermore, the coating film 64 is not an essential constituent element, and a configuration without the coating film 64 may be available.

The upper surface of the second magnetic layer 12 (the first principal surface 10*a* of the element body 10) is a ground surface formed by grinding. Therefore, on the upper surface, the metal magnetic powder 136 is exposed from the resin 135. The second magnetic layer 12 has recesses 135*a* in the resin 135 portion formed partially on the upper surface due to shedding of particles of the metal magnetic powder 46 during grinding.

Particularly, the metal film 63 is filled into the recesses 135*a* of the resin 135. This produces an anchor effect so that the adhesion between the metal film 63 and the second magnetic layer 12 can be improved. Additionally, as described later, the metal film 63 goes around along the outer surface of the metal magnetic powder 136 to the inner side of the second magnetic layer 12. In particular, the metal film 63 penetrates along the outer surface of the metal magnetic powder 136 into a gap between the resin 315 and the metal magnetic powder 136. As a result, the metal film 63 is firmly bonded to the metal magnetic powder 136 because of an increase in area of contact with the metal magnetic powder 136, and the anchor effect can be produced because of the contact with the second magnetic layer 12 along the shape of the recesses 135*a* of the resin 135, so that the adhesion between the metal film 63 and the second magnetic layer 12 can be improved. To fill the metal film 63 into the recesses 135*a*, for example, the metal film 63 may be formed by electroless plating as described later. The recesses 135*a* may not entirely be filled with the metal film 63 and may partially be filled with the metal film 63.

The thickness of the metal film 63 is equal to or less than ⅕ of the thickness of each of the first and second spiral wirings 21, 22. Specifically, the thickness of the metal film 63 is 1 μm or more and 10 μm or less (i.e., from 1 μm to 10 μm). As a result, the inductor component 1 can be reduced in height. Since the metal film 63 has a thickness of 1 μm or more, the metal film 63 can favorably be manufactured and, since the metal film 63 has a thickness of 10 μm or less, the inductor component 1 can be reduced in height.

The first external terminal 41 is protruded upward relative to the insulating film 50. In other words, the thickness of the first external terminal 41 is larger than the film thickness of the insulating film 50, so that the mounting stability can be improved when the first external terminal 41 is mounted.

(Manufacturing Method)

A method of manufacturing the inductor component 1 will be described.

The spiral wirings 21, 22 are formed on the upper surface 61*b* of the insulating layer 61 by sputtering, electroless plating etc., and the columnar wirings 31 to 34 extending upward from the spiral wirings 21, 22 are formed.

Subsequently, a magnetic sheet made of a magnetic material is pressure-bonded to the upper surface 61*b* of the insulating layer 61 to form the second magnetic layer 12 on the insulating layer 61 so as to cover the spiral wirings 21, 22 and the columnar wirings 31 to 34. The second magnetic layer 12 is polished to expose the end surfaces of the columnar wirings 31 to 34.

Subsequently, the insulating film 50 is formed on the upper surface of the second magnetic layer 12. In a region of the insulating film 50 where the external terminals are to be formed, through-holes are formed to expose the end surfaces of the columnar wirings 31 to 34 and the second magnetic layer 12.

Subsequently, the insulating layer 61 is removed by polishing. In this polishing, the insulating layer 61 is not completely removed and is partially left. A magnetic sheet made of a magnetic material is pressure-bonded to the lower surface 61*a* on the polished side of the insulating layer 61 and polished to a suitable thickness to form the first magnetic layer 11.

Subsequently, the metal film 63 grown from the columnar wirings 31 to 34 in the through-holes of the insulating film 50 is formed by electroless plating, and the coating film 64 covering the metal film 63 is also formed to form the external terminals 41 to 44.

Second Embodiment

Figure 3:
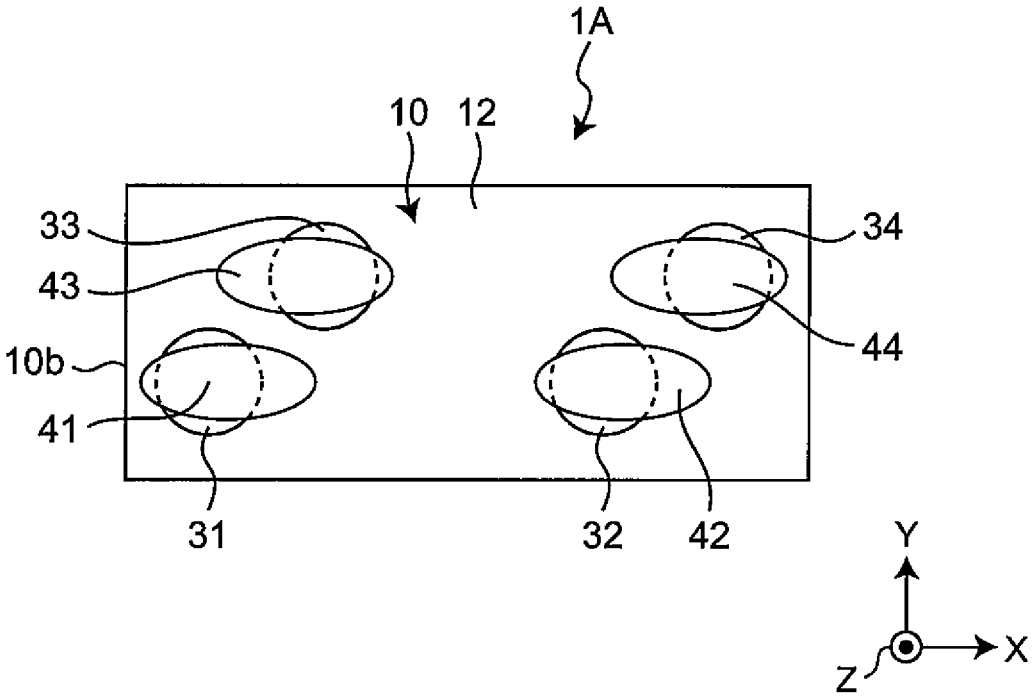
FIG. 3 is a plan view showing a second embodiment of an inductor component.

FIG. 3 is a plan view showing a second embodiment of the inductor component. The second embodiment is different from the first embodiment in the arrangement of the columnar wirings and the external terminals. This different configuration will hereinafter be described. The other constituent elements have the same configuration as the first embodiment and are denoted by the same reference numerals as the first embodiment and will not be described.

As shown in FIG. 3, in an inductor component 1A of the second embodiment, when viewed in the direction orthogonal to the first principal surface 10*a* of the element body 10, the first external terminal 41 and the third external terminal 43 are arranged in a direction intersecting with the first side surface 10*b* of the element body 10. More specifically, in the inductor component 1A, the first external terminal 41 and the third external terminal 43 are arranged obliquely with respect to the direction of extension of the first end edge 101. Therefore, the shortest distance between the first external terminal 41 and the third external terminal 43 is ensured obliquely with respect to the first end edge 101, so that the first end edge 101 can be made smaller without being restricted by the shortest distance. In FIG. 3, the insulating film 50 is not shown.

In the inductor component 1A, when viewed in the direction orthogonal to the first principal surface 10*a* of the element body 10, the first external terminal 41 and the third external terminal 43 have an elliptical shape. The elliptical shape is arranged with the major axis extending along the X direction. Therefore, the first external terminal 41 and the third external terminal 43 can be made closer without changing the shortest distance between the first external terminal 41 and the third external terminal 43. The first external terminal 41 and the third external terminal 43 may have a circular shape.

Furthermore, with the configuration as described above, the inductor component 1A can achieve a configuration in which the shortest distance between the first external terminal 41 and the third external terminal 43 in the direction along the first end edge 101 (the width direction Y) is 350 μm or less, for example. Specifically, for example, in a configuration such as that of the inductor component 1, in general, a shortest distance equal to or less than 350 μm between the first external terminal 41 and the third external terminal 43 adjacent to each other increases a degree of difficulty in preventing short-circuiting of mounted solder, and therefore, the shortest distance between the first external terminal 41 and the third external terminal 43 is ensured to be greater than 350 μm in the direction along the first end edge 101.

In contrast, in the inductor component 1A, the shortest distance between the first external terminal 41 and the third external terminal 43 is ensured obliquely with respect to the first end edge 101, so that the distance between the adjacent external terminals along the first end edge 101 can be reduced to 350 μm or less. Therefore, the outer shape of the inductor component 1 along the first end edge 101 can be made smaller than usual while maintaining prevention of short-circuiting of mounting solder at the time of mounting on a substrate.

Similarly, when viewed in the direction orthogonal to the first principal surface 10*a* of the element body 10, the second external terminal 42 and the fourth external terminal 44 are arranged in a direction intersecting with the first side surface 10*b* of the element body 10, and the second external terminal 42 and the fourth external terminal 44 have an elliptical shape or a circular shape. The shortest distance between the second external terminal 42 and the fourth external terminal 44 is 350 μm or less, for example.

The present disclosure is not limited to the embodiments described above and may be changed in design without departing from the spirit of the present disclosure. For example, respective feature points of the first and second embodiments may variously be combined.

In the embodiment, two inductors, i.e., the first inductor 2A and the second inductor 2B, are disposed in the element body 10; however, three or more inductors may be disposed and, in this case, six or more each of the external terminals and the columnar wirings are included. In this case, in the first embodiment, the pluralities of external terminals and columnar wirings adjacent in the Y direction are each linearly arranged along the Y direction. In the second embodiment, the pluralities of external terminals and columnar wirings adjacent in the Y direction are each arranged in zigzag along the Y direction.

In the configuration in which the first external terminal is located closer to the third external terminal than the fourth external terminal, at least the shortest distance between the first external terminal and the third external terminal may be longer than the shortest distance between the first columnar wiring and the third columnar wiring, and the insulating film may cover at least a portion of the end surface of the first columnar wiring not in contact with the first external terminal and a portion of the end surface of the third columnar wiring not in contact with the third external terminal. In other words, the relationship described above may be satisfied in at least one set of adjacent external terminals and columnar wirings included in the pluralities of external terminals and columnar wirings.

In the embodiments, the number of turns of the spiral wirings included in the inductor is less than one; however, the spiral wirings may have a curve with the number of turns exceeding one. The total number of layers of the spiral wirings included in the inductor is not limited to one, and the spiral wirings may have a multilayer configuration including two or more layers. The first spiral wiring of the first inductor and the second spiral wiring of the second inductor are not limited to the configuration arranged on the same plane parallel to the first principal surface, and the first spiral wiring and the second spiral wiring may be arranged in a direction orthogonal to the principal surface.

What is claimed is:

1. An inductor component comprising:

an element body;

a first inductor and a second inductor disposed in the element body;

first and second columnar wirings that are embedded in the element body with end surfaces exposed from a first principal surface of the element body and that are electrically connected to the first inductor, and third and fourth columnar wirings that are embedded in the element body with end surfaces exposed from the first principal surface of the element body and that are electrically connected to the second inductor;

a first external terminal in contact with the end surface of the first columnar wiring, a second external terminal in contact with the end surface of the second columnar wiring, a third external terminal in contact with the end surface of the third columnar wiring, and a fourth external terminal in contact with the end surface of the fourth columnar wiring, the first external terminal being located closer to the third external terminal than the fourth external terminal; and an insulating film disposed on the first principal surface of the element body, wherein a shortest distance between the first external terminal and the third external terminal is longer than a shortest distance between the first columnar wiring and the third columnar wiring, and the insulating film covers a portion of the end surface of the first columnar wiring not in contact with the first external terminal and a portion of the end surface of the third columnar wiring not in contact with the third external terminal.

2. The inductor component according to claim 1, wherein the element body includes a magnetic layer covering the first inductor and the second inductor and made of a resin containing a metal magnetic powder.

3. The inductor component according to claim 2, wherein the first external terminal includes a metal film in contact with the resin and the metal magnetic powder of the magnetic layer and the end surface of the first columnar wiring.

4. The inductor component according to claim 1, wherein the first external terminal is disposed from the end surface of the first columnar wiring onto the first principal surface of the element body.

5. The inductor component according to claim 4, wherein a portion of the first external terminal disposed to extend onto the first principal surface does not extend in the direction toward the third external terminal.

6. The inductor component according to claim 1, wherein
the first principal surface of the element body includes a linearly extending first end edge, and
the first external terminal and the third external terminal are arranged along the first end edge.

7. The inductor component according to claim 1, wherein
the first principal surface of the element body includes a linearly extending first end edge, and
the first external terminal and the third external terminal are arranged obliquely with respect to a direction of extension of the first end edge.

8. The inductor component according to claim 6, wherein when viewed in a direction orthogonal to the first principal surface of the element body, the first external terminal and the third external terminal are elliptical or circular.

9. The inductor component according to claim 6, wherein the shortest distance between the first external terminal and the third external terminal in a direction along the first end edge is 350 μm or less.

10. The inductor component according to claim 1, wherein
the second external terminal is located closer to the fourth external terminal than the third external terminal,
a shortest distance between the second external terminal and the fourth external terminal is longer than a shortest distance between the second columnar wiring and the fourth columnar wiring, and
the insulating film covers a portion of the end surface of the second columnar wiring not in contact with the second external terminal and a portion of the end surface of the fourth columnar wiring not in contact with the fourth external terminal.

11. The inductor component according to claim 1, wherein
the first columnar wiring, the second columnar wiring, the third columnar wiring, and the fourth columnar wiring linearly extend from the first inductor and the second inductor to the end surfaces in a direction orthogonal to the end surfaces.

12. The inductor component according to claim 1, wherein the first inductor and the second inductor include spiral wirings disposed parallel to the first principal surface of the element body.

13. The inductor component according to claim 2, wherein the first external terminal is disposed from the end surface of the first columnar wiring onto the first principal surface of the element body.

14. The inductor component according to claim 3, wherein the first external terminal is disposed from the end surface of the first columnar wiring onto the first principal surface of the element body.

15. The inductor component according to claim 2, wherein
the first principal surface of the element body includes a linearly extending first end edge, and
the first external terminal and the third external terminal are arranged along the first end edge.

16. The inductor component according to claim 2, wherein
the first principal surface of the element body includes a linearly extending first end edge, and
the first external terminal and the third external terminal are arranged obliquely with respect to a direction of extension of the first end edge.

17. The inductor component according to claim 7, wherein the shortest distance between the first external terminal and the third external terminal in a direction along the first end edge is 350 μm or less.

18. The inductor component according to claim 2, wherein
the second external terminal is located closer to the fourth external terminal than the third external terminal,
a shortest distance between the second external terminal and the fourth external terminal is longer than a shortest distance between the second columnar wiring and the fourth columnar wiring, and
the insulating film covers a portion of the end surface of the second columnar wiring not in contact with the second external terminal and a portion of the end surface of the fourth columnar wiring not in contact with the fourth external terminal.

19. The inductor component according to claim 2, wherein
the first columnar wiring, the second columnar wiring, the third columnar wiring, and the fourth columnar wiring linearly extend from the first inductor and the second inductor to the end surfaces in a direction orthogonal to the end surfaces.

20. The inductor component according to claim 2, wherein the first inductor and the second inductor include spiral wirings disposed parallel to the first principal surface of the element body.

* * * * *